United States Patent [19]

Sasaki

[11] 4,048,796

[45] Sept. 20, 1977

[54] TOUCH SENSITIVE ELECTRODES FORMED ON THE FRAME OF AN ELECTRONIC WRISTWATCH

[75] Inventor: Takehiko Sasaki, Yamatokoriyama, Japan

[73] Assignee: Sharp Kabushiki Kaisha, Osaka, Japan

[21] Appl. No.: 701,204

[22] Filed: June 30, 1976

[30] Foreign Application Priority Data

June 30, 1975 Japan ..... 50-91925[U]
Nov. 14, 1975 Japan ..... 50-155710[U]

[51] Int. Cl.[2] ..... G04B 37/00; G04C 3/00
[52] U.S. Cl. ..... 58/23 R; 58/23 A; 58/50 R; 58/88 R; 58/91
[58] Field of Search ..... 58/23 R, 23 A, 50 R, 58/88 R, 91

[56] References Cited

U.S. PATENT DOCUMENTS

| | | | |
|---|---|---|---|
| 3,742,699 | 7/1973 | Bergey | 58/50 R |
| 3,838,568 | 10/1974 | Zurcher et al. | 58/23 R X |
| 3,846,971 | 11/1974 | Ho et al. | 58/23 R |
| 3,911,664 | 10/1975 | Haber | 58/23 R |
| 3,939,643 | 2/1976 | Nishikubo | 58/23 A |
| 3,940,920 | 3/1976 | Nakamura et al. | 58/50 R X |
| 3,983,690 | 10/1976 | McClintock | 58/50 R |

*Primary Examiner*—Stanley J. Witkowsi
*Attorney, Agent, or Firm*—Birch, Stewart, Kolasch & Birch

[57] ABSTRACT

An upper metal frame or a bezel and a rear metal frame of an electronic wristwatch are electrically isolated from each other by interposing an insulating frame therebetween. The upper metal frame or the bezel is connected to one input terminal of a touch sensitive electronic switching circuitry disposed in the electronic wristwatch, whereas the rear metal frame is connected to another input terminal of the touch sensitive electronic switching circuitry.

6 Claims, 5 Drawing Figures

TOUCH SENSITIVE ELECTRODES FORMED ON THE FRAME OF AN ELECTRONIC WRISTWATCH

BACKGROUND OF THE INVENTION

The present invention relates to an electronic wristwatch including a touch sensitive electronic switching circuitry for introducing various commands from the operator and, more particularly, to a touch sensitive electrode structure connected to input terminals of the touch sensitive electronic switching circuitry.

It has been proposed to provide a touch sensitive electronic switching circuitry in an electronic wristwatch because the touch sensitive electronic switching assembly is easy to handle as compared with the mechanical switching structure such as a pushbutton switch or a stem, and the touch sensitive electronic switching circuitry can be incorporated in a C-MOSLSI chip including a time keeping circuit of the electronic wristwatch.

The touch sensitive electronic switching circuitry usually comprises two input terminals, one being connected to a metal rear frame of an electronic wristwatch and the other being connected to a transparent electrode film formed on a front glass window of the electronic wristwatch. In such a system there is a possibility that the front glass window is damaged or becomes dirty since the operator often touches the transparent electrode film formed on the front glass window. The circuit constant of the touch sensitive electronic switching circuitry is difficult to determine, and the insulation must be strictly maintained since the contact resistance is considerably high between the operator's body and the transparent electrode film. Moreover, the front window portion must be made of glass, since other material such as transparent plastics is not suited for the transparent electrode formation.

OBJECTS AND SUMMARY OF THE INVENTON

Accordingly, an object of the present invention is to provide a novel touch sensitive electrode assembly associated with a touch sensitive electronic switching circuitry included within an electronic wristwatch.

Another object of the present invention is to utilize a bezel of an electronic wristwatch as a touch sensitive electrode for introducing commands into the electronic wristwatch.

Still another object of the present invention is to provide a touch sensitive electronic switching circuitry of high reliability.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, an upper metal frame and a rear metal frame of an electronic wristwatch are electrically isolated from each other by interposing an insulating frame therebetween. The upper metal frame is connected to one input terminal of a touch sensitive electronic switching circuitry disposed in the electronic wristwatch, and the rear metal frame is connected to another input terminal of the touch sensitive electronic switching circuitry.

In another preferred form, a bezel for supporting a front glass window is electrically isolated from the metal frame of the electronic wristwatch, and the bezel is electrically connected to the touch sensitive electronic switching circuitry, whereby the bezel functions as an electrode for performing the touch switch operation.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
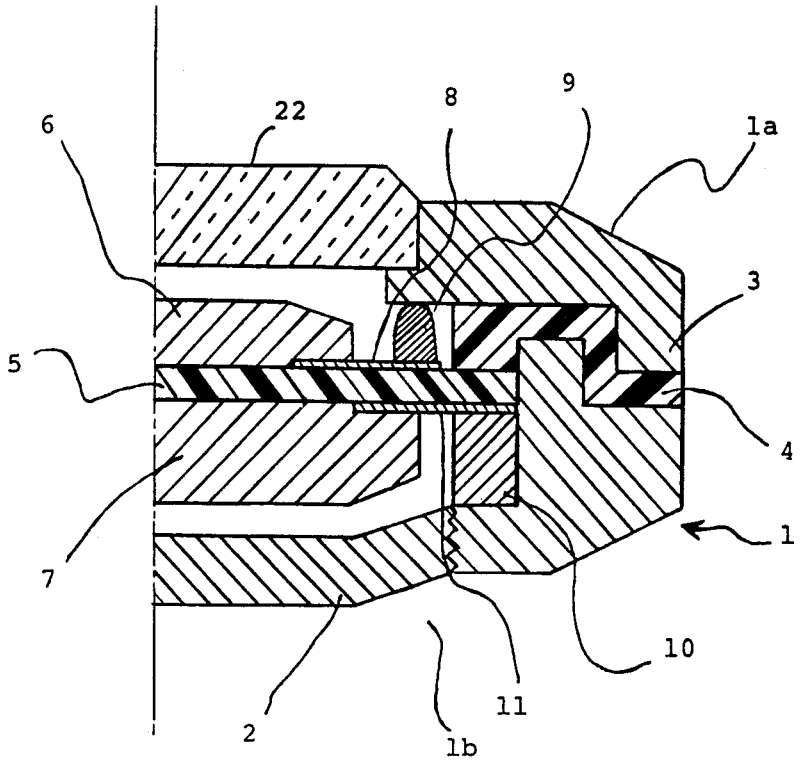
FIG. 1 is a cross-sectional view of an embodiment of an electronic wristwatch of the present invention.

Referring now to FIG. 1, there is illustrated an embodiment of an electronic wristwatch of the present invention, a watch case 1 mainly comprises a metal rear frame 2 and a metal side frame 3. An insulating ring 4 made of plastics is interposed within the side frame 3, thereby to electrically isolate a front case 1*a* and a back cover 1*b* from each other.

A substrate 5 made of ceramics or resin is provided for supporting a display unit 6, such as a liquid crystal display unit or a light-emitting diode display unit, on its upper surface and an electronic circuit assembly 7 on its rear surface, and for electrically connecting them to each other. Electrical connection between the front case 1*a* and the electronic circuit assembly 7 is achieved through a connector 9 made of conductive rubber or conductive springs and a wiring pattern 8 formed on the upper surface of the substrate 5. Electrical connection between the back cover 1*b* and the electronic circuit assembly 7 is achieved through an internal metal frame 10 and a wiring pattern 11 formed on the rear surface of the substrate 5.

Figure 2:
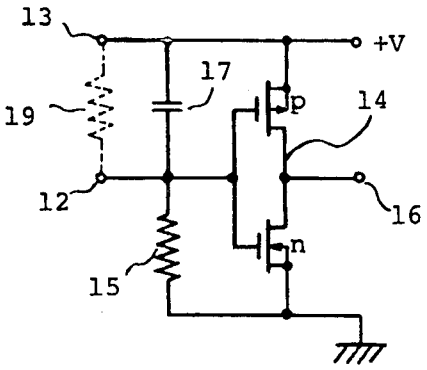
FIG. 2 is a circuit diagram of a touch sensitive electronic switching circuitry included within the electronic wristwatch of the present invention.

FIG. 2 shows a typical circuit construction of a touch sensitive electronic switching circuitry.

In FIG. 2, an input terminal 12 is connected to the front case 1*a*, and another input terminal 13 is connected to the back cover 1*b*. In the normal condition, an input level of a C-MOS inverter 14 is pulled down to the low level (logical value 0) by a resistor 15 and, therefore, an output terminal 16 develops a signal of the high level (logical value 1). A capacitor 17 cooperates with the resistor 15 to form a filter circuit, thereby preventing the entrance of induced noise.

Figure 3:
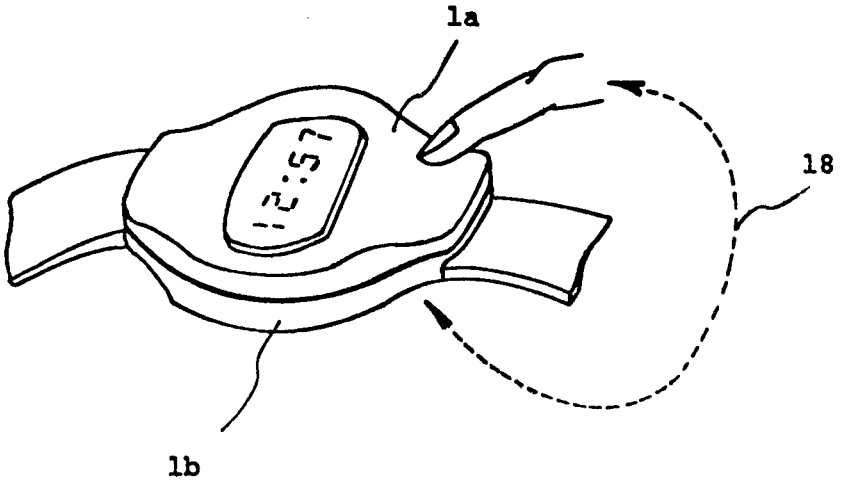
FIG. 3 is a perspective view showing an operating mode of the electronic wristwatch of the present invention.

When the operator touches the front case 1*a* as shown in FIG. 3 under the condition where the operator wears the wristwatch, an electrical current loop 18 is formed from the back cover 1b to the front case 1a through the operator's body. That is, the input terminals 12 and 13 are connected with each other through a resistor 19 of the operator's body and, hence, the input level of the C-MOS inverter 14 becomes identical with the voltage level divided by the resistors 15 and 19. This renders the input level of the C-MOS inverter 14 above the threshold level $V_T$, that is, the input level becomes the high level (logical value 1) and, therefore, the output signal of the C-MOS inverter 14 is inverted from the high level (logical value 1) to the low level (logical value 0). This inversion of the output signal level can be used as a command for controlling, for example, the enabling of the display unit 6 or the time correction operation.

Figure 4:
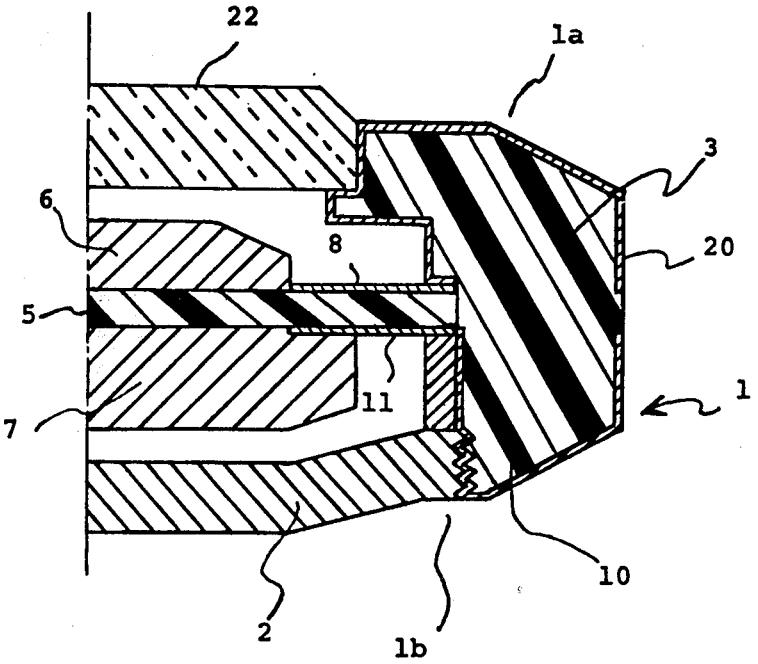
FIG. 4 is a cross-sectional view of another embodiment of an electronic wristwatch of the present invention.

FIG. 4 shows another embodiment of an electronic wristwatch of the present invention, wherein the side frame 3 is made of insulating material such as plastics. The surface of the side frame 3 is coated with metal layers 20 through the use of plating technique in such a manner that the central portion thereof is not coated with the metal layer 20 so that the front case 1a and the back cover 1b are electrically isolated from each other.

The electrical connection between the front case 1a and the electronic circuit assembly 7, and the electrical connection between the back cover 1b and the electronic circuit assembly 7 can be achieved in a same manner as for the embodiment shown in FIG. 1. Alternatively, the wiring patterns 8 and 11 formed on the substrate 5 can be directly connected to the metal layers 20 as shown in FIG. 4.

Figure 5:
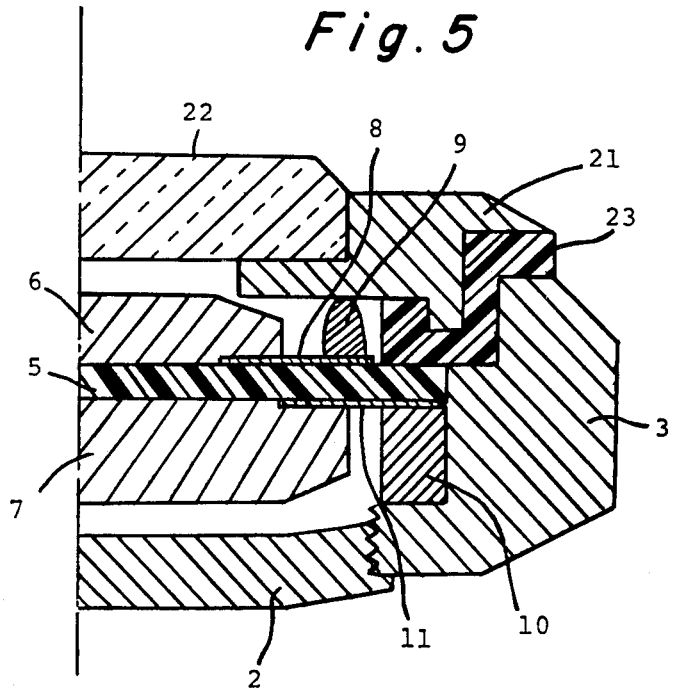
FIG. 5 is a cross-sectional view of still another embodiment of an electronic wristwatch of the present invention.

FIG. 5 shows still another embodiment of an electronic wristwatch of the present invention. Like elements corresponding to those of FIG. 1 are indicated by like numerals.

A bezel 21 made of metal is provided for supporting a front glass window 22. The bezel 21 is electrically insulated from the side frame 3 by interposing an insulating ring 23 made of, for example, teflon between the bezel 21 and the side frame 3. The bezel 21 is connected to the input terminal 12 of the touch sensitive electronic switching circuitry shown in FIG. 2 through the wiring pattern 8 and the connector 9.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In an electronic timepiece including a front metal casing, a rear metal casing and a touch sensitive electronic switching circuitry, the improvement comprising:

an insulating ring for electrically isolating the front metal casing from the rear metal casing; and a connection means for electrically connecting the front metal casing to an input terminal of the touch sensitive electronic switching circuitry.

2. The electronic timepiece of claim 1, wherein the insulating ring is interposed between the front metal casing and the rear metal casing, and the insulating ring is made of plastics.

3. In an electronic timepiece including a front metal casing, a rear metal casing, and an electronic circuitry assembly which includes a touch sensitive electronic switching circuitry of which output signals are used for controlling the operation mode of the electronic timepiece, the touch sensitive electronic switching circuitry having two input terminals, the improvement comprising:

an insulating ring for electrically isolating the front metal casing from the rear metal casing;

a first connection means for electrically connecting the front metal casing to one input terminal of the touch sensitive electronic switching circuitry; and a second connection means for electrically connecting the rear metal casing to the other input terminal of the touch sensitive electronic switching circuitry.

4. The electronic timepiece of claim 3, wherein the touch sensitive electronic switching circuitry comprises a C-MOS inverter.

5. In an electronic wristwatch including a front glass window, a bezel made of metal for supporting the front glass window, a metal casing, and an electronic circuit assembly including a touch sensitive electronic switching circuitry of which output signals are used for controlling the operation mode of the electronic wristwatch, the touch sensitive electronic switching circuitry having two input terminals, the improvement comprising:

an insulating ring interposed between the bezel and the metal casing;

a first connection means for electrically connecting the bezel to one input terminal of the touch sensitive electronic switching circuitry; and a second connection means for electrically connecting the metal casing to the other input terminal of the touch sensitive electronic switching circuitry.

6. The electronic wristwatch of claim 5, wherein the touch sensitive electronic switching circuitry comprises a C-MOS inverter.

* * * * *